US008201647B2

(12) United States Patent
Zulak

(10) Patent No.: US 8,201,647 B2
(45) Date of Patent: Jun. 19, 2012

(54) EARTH DRILLING REAMER WITH REPLACEABLE BLADES

(76) Inventor: Mike Zulak, Spruce Grove (CA)

( * ) Notice: Subject to any disclaimer, the term of this patent is extended or adjusted under 35 U.S.C. 154(b) by 253 days.

(21) Appl. No.: 12/684,384

(22) Filed: Jan. 8, 2010

(65) Prior Publication Data

US 2010/0175927 A1 Jul. 15, 2010

(51) Int. Cl.
*E21B 10/26* (2006.01)

(52) U.S. Cl. ..... 175/406; 175/53

(58) Field of Classification Search ..... 175/53, 175/62, 385, 406; 405/138
See application file for complete search history.

(56) References Cited

U.S. PATENT DOCUMENTS

| | | | | |
|---|---|---|---|---|
| 1,764,373 | A * | 6/1930 | Wells et al. | 175/283 |
| 1,937,742 | A | 12/1933 | Brink | |
| 2,088,770 | A | 8/1937 | Skinner | |
| 3,036,611 | A | 5/1962 | Reuter | |
| 3,051,255 | A | 8/1962 | Deely | |
| 3,556,233 | A * | 1/1971 | Gilreath et al. | 175/267 |
| 4,190,124 | A * | 2/1980 | Terry | 175/406 |
| 5,027,914 | A * | 7/1991 | Wilson | 175/406 |
| 5,447,207 | A | 9/1995 | Jones | |
| 5,487,426 | A * | 1/1996 | O'Hair | 166/378 |
| 6,227,312 | B1 | 5/2001 | Eppink et al. | |
| 6,926,100 | B1 * | 8/2005 | Anthony et al. | 175/62 |
| 7,048,064 | B1 * | 5/2006 | Smith | 166/382 |
| 7,108,082 | B1 * | 9/2006 | Anthony et al. | 175/53 |
| 7,188,689 | B2 | 3/2007 | Maxwell et al. | |
| 7,308,937 | B2 | 12/2007 | Radford et al. | |
| 8,020,635 | B2 * | 9/2011 | Radford | 175/57 |
| 2011/0226531 | A1 * | 9/2011 | Jones | 175/50 |

OTHER PUBLICATIONS

Maxwell Wetmore Reamers Publication. Located at http://www.maxwellwetmore.com/Product_Index/Reamers/reamers.html available as early as Apr. 2006.—(3 pgs.).
Maxwell Wetmore—Type R7 Shell Reamers. Located at http://www.maxwellwetmore.com/Product_Index/Reamers/type_r7.html available as early as Apr. 2006.—(2 pgs.).
Halliburton Security DBS Drill Bits. Located at http://www.halliburton.com/public/sdbs/sdbs_contents/Brochures/Web/H03022.asp as late as May 2008.—(4 pgs.).

* cited by examiner

*Primary Examiner* — Daniel P Stephenson
(74) *Attorney, Agent, or Firm* — Davis & Bujold, P.L.L.C.

(57) ABSTRACT

An earth drilling reamer has an elongated body having an outer surface and a plurality of blade mounting supports extending radially outwardly from the outer surface of the body. Each blade mounting support has a primary blade engagement positioned parallel to the outer surface and a leading blade angled from the outer surface to the primary blade engagement. A removable primary blade is detachably secured to the primary blade engagement.

6 Claims, 3 Drawing Sheets

EARTH DRILLING REAMER WITH REPLACEABLE BLADES

FIELD

The present invention relates to a reamer that is used to enlarge holes made by earth drilling equipment.

BACKGROUND

When installing utility lines a pilot borehole is made under a river or other natural or man made obstacle. A series of reamers are then used to incrementally increase the size of the pilot borehole.

SUMMARY

There is provided an earth drilling reamer, comprising an elongated body having an outer surface, and a plurality of blade mounting supports extending radially outwardly from the outer surface of the body. Each blade mounting support has a primary blade engagement positioned parallel to the outer surface and a leading blade angled from the outer surface to the primary blade engagement. A removable primary blade is detachably secured to the primary blade engagement.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
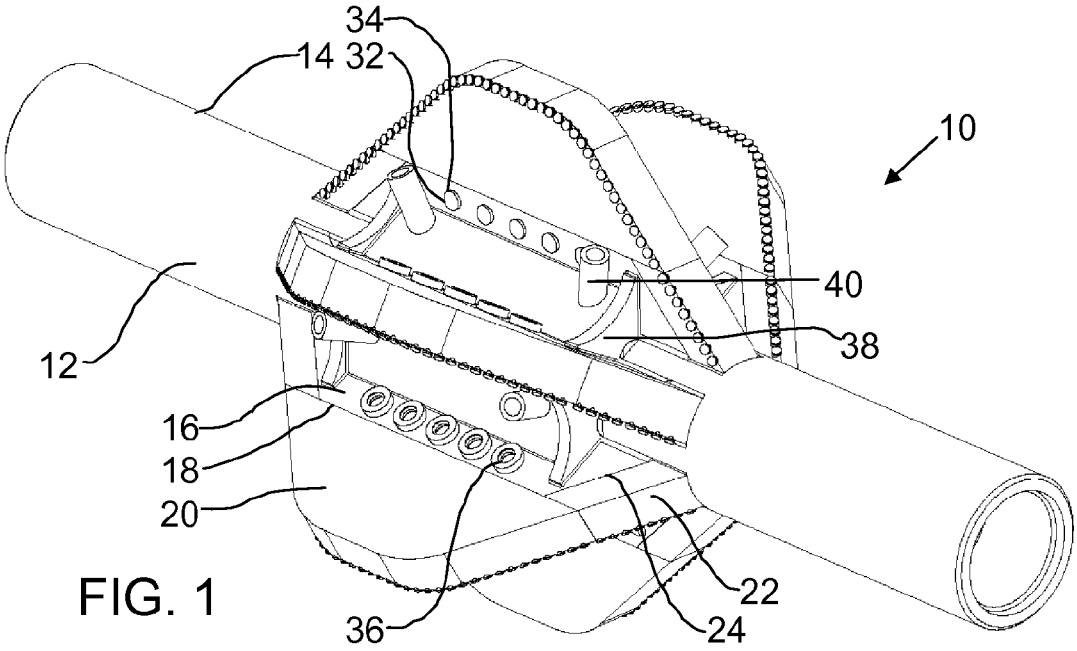
FIG. 1 is a perspective view of an earth drilling reamer.

An earth drilling reamer generally identified by reference numeral 10 will now be described with reference to FIG. 1 through 6.

Figure 3:
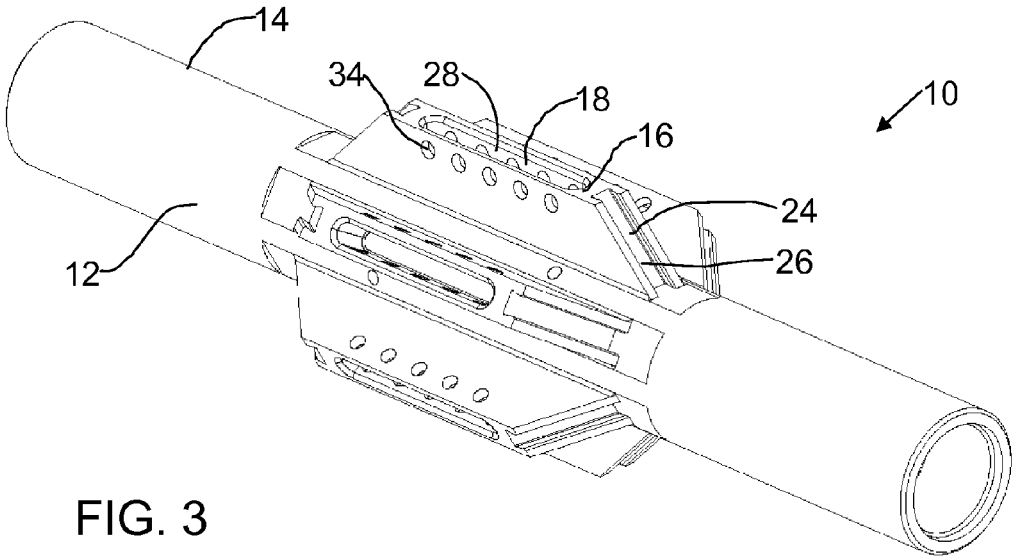
Figure 5:
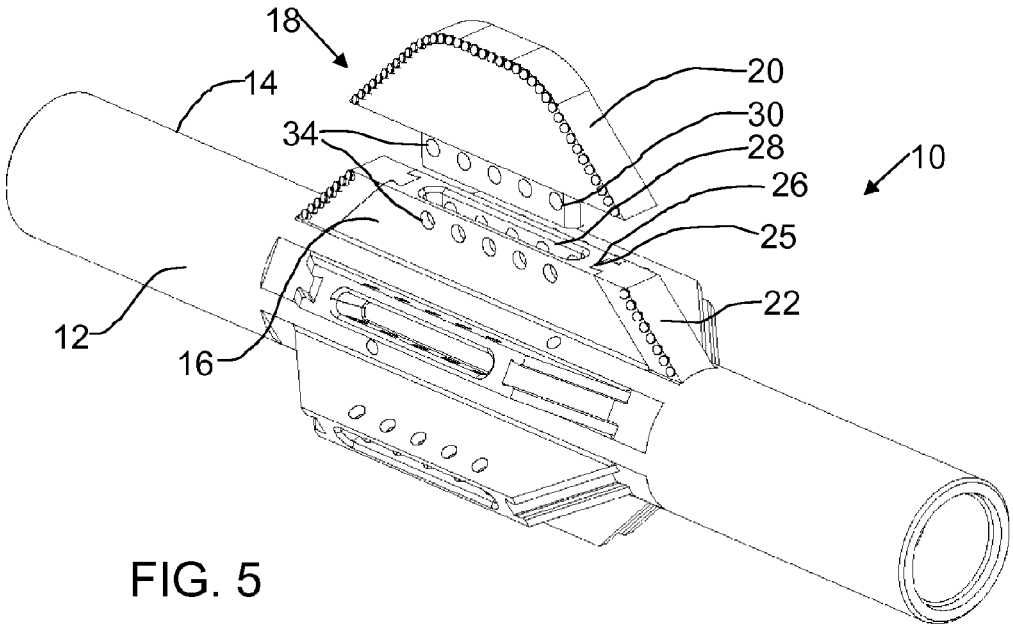

Structure and Relationship of Parts:

Referring to FIG. 1, earth drilling reamer 10 has an elongated body 12 with an outer surface 14. A plurality of blade mounting supports 16 extend radially outwardly from outer surface 14 of body 12. Referring to FIG. 3, each blade mounting support 16 has a primary blade engagement 18 positioned parallel to outer surface 14. Referring to FIG. 5, a removable primary blade 20 is detachably secured to primary blade engagement 18. Each blade mounting support 16 also has a leading blade 22 angled from outer surface 14 to primary blade engagement 18.

Figure 4:
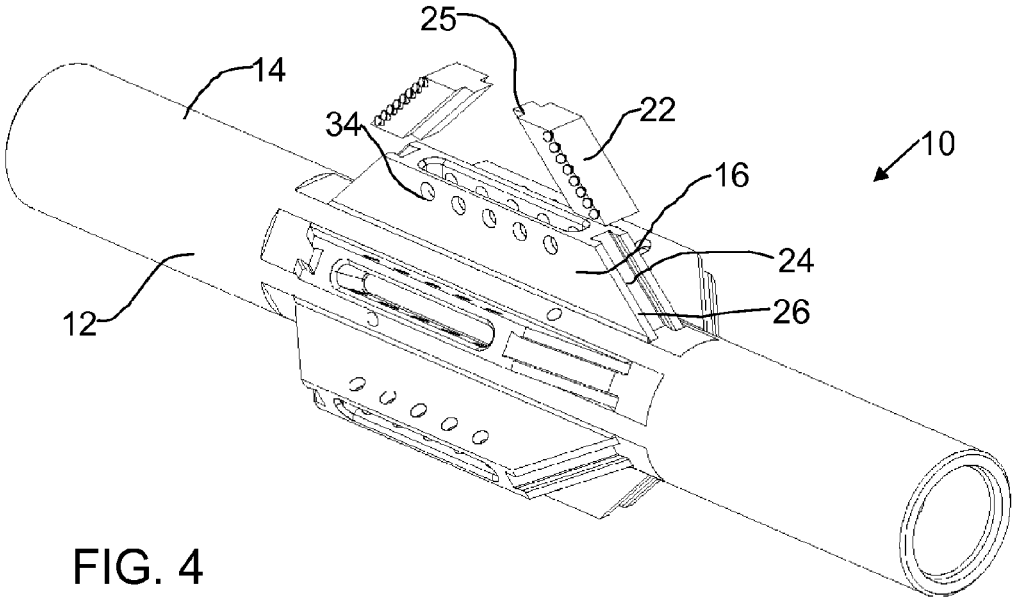

While leading blade 22 may be part of blade mounting support 16, in a preferred embodiment, leading blade 22 is also removable as with primary blade 20, as shown in FIG. 4. As depicted, blade 22 is detachably secured to a leading blade engagement 24 that is angled from outer surface 14 of body 12 to primary blade engagement 18. Leading blade engagement 24 has a track 26 that terminates at primary blade engagement 18. Leading blade 22 has an engagement 25 that engages track 26. Preferably, referring to FIG. 5, the engagement between primary blade 20 and primary blade engagement 18 prevents leading blade 22 from being removed from track 26.

Figure 6:
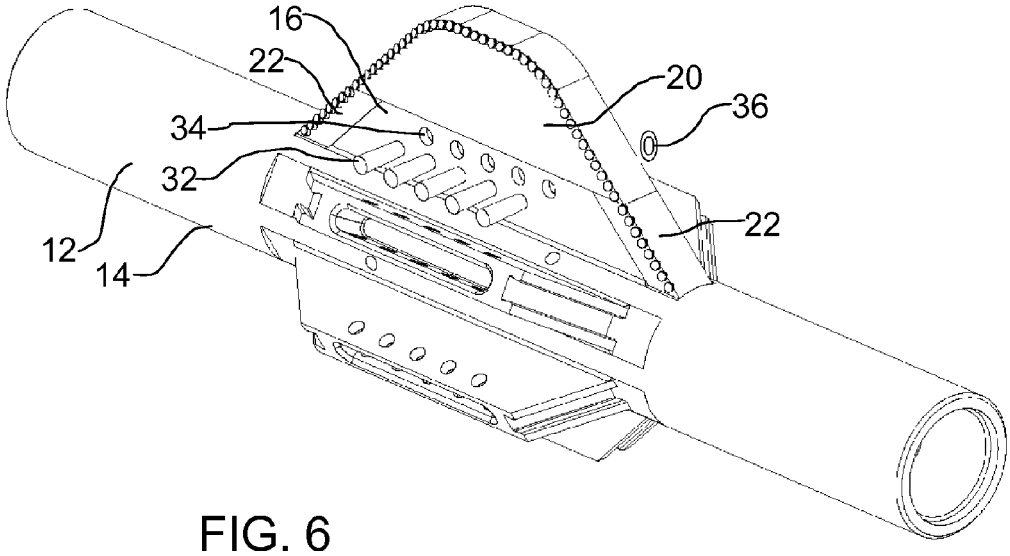

In one embodiment, referring to FIG. 5, primary blade engagement 18 is comprised of a female receptacle 28 and primary blade 20 has a male member 30 which is received in female receptacle 28, with a locking assembly being provided to prevent male member 22 from being withdrawn from female receptacle 28. As depicted in FIG. 6, the locking assembly includes pins 32 that are inserted through holes 34 in both female receptacle 28 and male member 22. Pins 32 are secured by lock nuts 36.

Referring to FIG. 1, in order to provide additional strength to blade mounting supports 16, ribs 38 may be provided that extend between adjacent supports 16. In addition, it may be desireable to provide fluid flow channels 40 that act as jets to circulate fluids around blades 20 and 22 to remove debris, lubricate, or cool blades 20 and 22 in order to prolong the life expectancy of blades 20 and 22.

Figure 2:
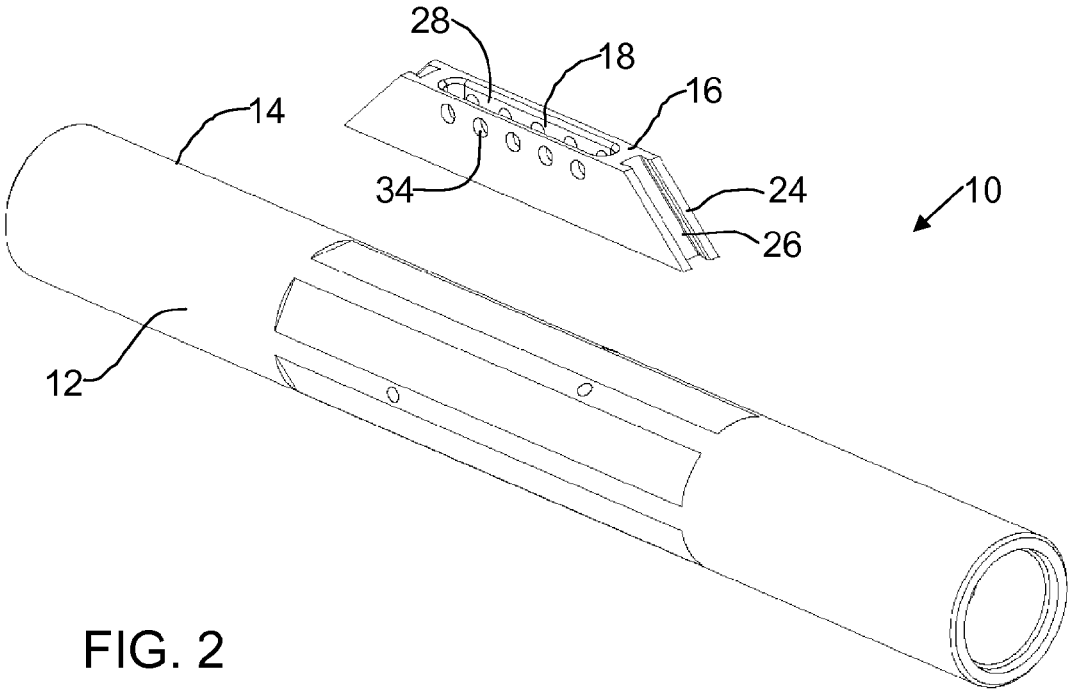
FIG. 2 through 6 are perspective views of the earth drilling reamer being assembled.

Operation/Assembly:

Referring to FIG. 2, primary blade engagement 18 is secured to outer surface 14 of elongated body 12. Referring to FIG. 3, multiple primary blade engagements 18 are spaced about outer surface 14. Referring to FIG. 4, leading blades 22 are secured to primary blade engagement by sliding engagement 25 through track 26 of leading blade engagement 24. Referring to FIG. 5, primary blade 20 is then secured by inserting male member 30 into female receptacle 28 and, referring to FIG. 6, by inserting pins 32 through holes 34 in primary blade engagement 18 and primary blade 34 (seen in FIG. 5). Pins are secured by lock nuts 36.

Referring to FIG. 1, once blades 20 and 22 are assembled, other components such as ribs 38 and flow channels 40 may be installed.

In use, earth drilling reamer 10 may be operated by rotating body 12 and pushing and or pulling. It may be desireable to provide a variety of sizes of blades 20 and 22, and primary blade engagements 18 if necessary to cut different sizes of boreholes, or to progressively increase the size of a borehole. Alternatively, blades 20 and 22 may be designed for different soil types. When blades 20 and 22 become worn out or broken, they are replaced by removing pins 32 and inserting new blades 20 and 22, as described above.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. An earth drilling reamer, comprising:

an elongated body having an outer surface;

a plurality of blade mounting supports extending radially outwardly from the outer surface of the body, each blade mounting support having a primary blade engagement positioned parallel to the outer surface;

a removable primary blade detachably secured to the primary blade engagement; and a leading blade engagement angled from the outer surface of the body to the primary blade engagement; and a leading blade detachably secured to the leading blade engagement.

2. The earth drilling reamer of claim 1, wherein the leading blade engagement is comprised of a track that terminates at the primary blade engagement, the leading blade has an engagement that engages the track and the engagement of the primary blade with the primary blade engagement prevents the leading blade from being removed from the track.

3. The earth drilling reamer of claim 1, wherein the primary blade engagement is comprised of a female receptacle and the primary blade has a male member which is received in the female receptacle, with a locking assembly being provided to prevent the male member from being withdrawn from the female receptacle.

4. An earth drilling reamer comprising:

an elongated body having an outer surface;

a plurality of blade mounting supports extending radially outwardly from the outer surface of the body, each blade mounting support having a primary blade engagement positioned parallel to the outer surface and a leading blade angled from the outer surface to the primary blade engagement;

a removable primary blade detachably secured to the primary blade engagement, the primary blade engagement comprising a female receptacle and the primary blade having a male member which is received in the female receptacle; and a locking assembly that prevents the male member from being withdrawn from the female receptacle.

5. The earth drilling reamer of claim 4, wherein a leading blade engagement is angled from the outer surface of the body to the primary blade engagement and the leading blade is detachably secured to the leading blade engagement.

6. The earth drilling reamer of claim 4, wherein a leading blade engagement is comprised of a track that terminates at the primary blade engagement, the leading blade has an engagement that engages the track and the engagement of the primary blade with the primary blade engagement prevents the leading blade from being removed from the track.

* * * * *